United States Patent [19]

Mertz et al.

[11] Patent Number: 4,866,780

[45] Date of Patent: Sep. 12, 1989

[54] LOUDSPEAKER UNIT

[75] Inventors: Pascal Mertz, Barthelemy, France; Karl-Heinz A. A. O. Thiele, Peine; Werner Stehn, Hemmingen, both of Fed. Rep. of Germany

[73] Assignee: Electronic-Werke Deutschland GmbH, Villingen-Schwenningen, Fed. Rep. of Germany

[21] Appl. No.: 250,279

[22] Filed: Sep. 27, 1988

[30] Foreign Application Priority Data

Sep. 29, 1987 [DE] Fed. Rep. of Germany ..... 3732743

[51] Int. Cl.[4] ..... H04R 1/02; H04R 7/22

[52] U.S. Cl. ..... 381/188; 381/205; 248/27.3; 248/558; 181/171; 312/7.2

[58] Field of Search ..... 381/205, 188, 86, 88; 312/7.1, 7.2; 248/27.1, 27.3, 558, DIG. 6; 181/141, 150, 171

[56] References Cited

U.S. PATENT DOCUMENTS

| | | | |
|---|---|---|---|
| 3,964,705 | 6/1976 | Giovanni | 248/27.1 |
| 4,032,725 | 6/1977 | McGee | 248/27.1 |
| 4,503,292 | 3/1985 | Johnson et al. | 381/193 |
| 4,546,850 | 10/1985 | Litner | 381/188 |
| 4,602,382 | 7/1986 | Gabbay et al. | 381/86 |
| 4,733,748 | 3/1988 | Ponticelli, Jr. | 381/86 |
| 4,752,962 | 6/1988 | Thiele et al. | 381/188 |

FOREIGN PATENT DOCUMENTS

| | | | |
|---|---|---|---|
| 8402128 | 5/1984 | Fed. Rep. of Germany . | |
| 3424434 | 10/1985 | Fed. Rep. of Germany | 248/27.1 |
| 3601876 | 7/1987 | Fed. Rep. of Germany . | |

*Primary Examiner*—Jin F. Ng
*Assistant Examiner*—Wing F. Chan
*Attorney, Agent, or Firm*—Joseph S. Tripoli; Peter M. Emanuel; Frederick A. Wein

[57] ABSTRACT

A frame for a loudspeaker unit used, for example, in a television receiver, has provisions for optionally fastening one type of loudspeaker to the frame by a positively-locking fastening arrangement or another type of loudspeaker by screw fastening. Specifically, the frame includes both a positively-locking click-stop arrangement for snap-in fastening, and also clip elements for holding the loudspeaker during a screwing operation.

7 Claims, 1 Drawing Sheet

LOUDSPEAKER UNIT

FIELD OF THE INVENTION

The invention concerns an arrangement for fastening a loudspeaker to a frame.

BACKGROUND OF THE INVENTION

A loudspeaker unit generally consists of a frame, which serves as a sound guide, and has a sound opening and a loudspeaker fastened thereto. The frame can be, for example, the front portion of a television receiver, the front side of a loudspeaker box, or the wall of a radio mounted on the dashboard of a motor vehicle.

It is known to secure the loudspeaker to the frame by a positively-locking so-called click-stop or snap-in fastening arrangement. In this case, the fastening operation can take place by a pure translation movement of the loudspeaker, which is advantageous particularly for assembly by robots. Moreover, in this solution, no screws, which form additional components and which lengthen the time required for the fastening operation, are necessary. Such a fastening arrangement is advantageous particularly for loudspeakers which have a plastic chassis frame. Fastening a loudspeaker by means of a positive-locking click-stop or snap-in fastening arrangement, without screws, to the front frame of a television receiver housing is described in German patent DE-GM No. 84 02 128.

On the other hand, it is known and, in many cases necessary, to secure the loudspeaker to the frame with screws. This solution is preferred particularly in the case of loudspeakers with a metal chassis because a click-stop or snap-in fastening arrangement is less advantageous for this purpose. Many equipments optionally utilize either loudspeakers with a plastic chassis or with a metal chassis. In that case, different types of fastening arrangements are necessary.

SUMMARY OF THE INVENTION

The invention is directed to a frame for a loudspeaker unit which is constructed in such a way that different types of loudspeakers can optionally be fixed to the same frame by a positively locking click-stop fastening operation, suitable for assembly by robots, or by a screw fastening operation.

Both types of fastening, namely that by means of a positive-locking click-stop fastening and that with screws, to the same frame are optimized by the solution according to the invention. Therefore, the same frame can be used for both kinds of fastening. This is particularly advantageous with respect to production and storage. Both kinds of fastening allow a pure translational movement of the loudspeaker, that is a movement in which all the points on the loudspeaker move in a straight line. This is particularly advantageous for assembling loudspeaker units using robots.

DETAILED DESCRIPTION OF THE DRAWINGS

To facilitate an understanding of the following description, concurrent reference to two or more of FIGS. 1–4 will be helpful.

Figure 3:
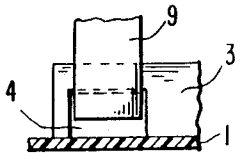
FIG. 3 shows a view of the frame shown in FIG. 1 taken in the direction of the section lines B—B.
Figure 4:
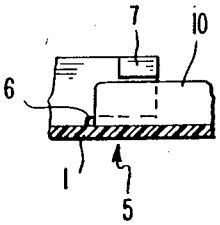
FIG. 4 shows a view of the frame shown in FIG. 1 taken in the direction of section lines C—C.
Figure 1:
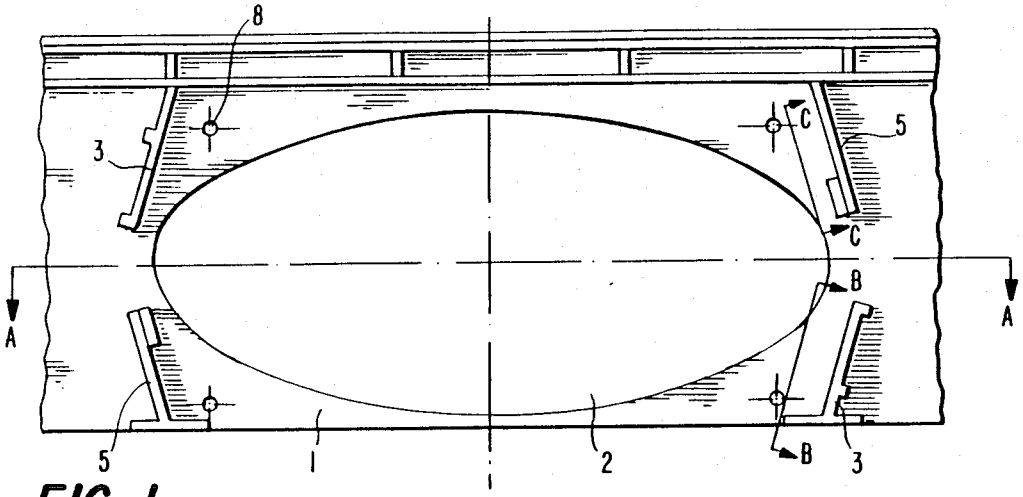
FIG. 1 shows a portion of the front frame of a television receiver from the rear.
Figure 2:
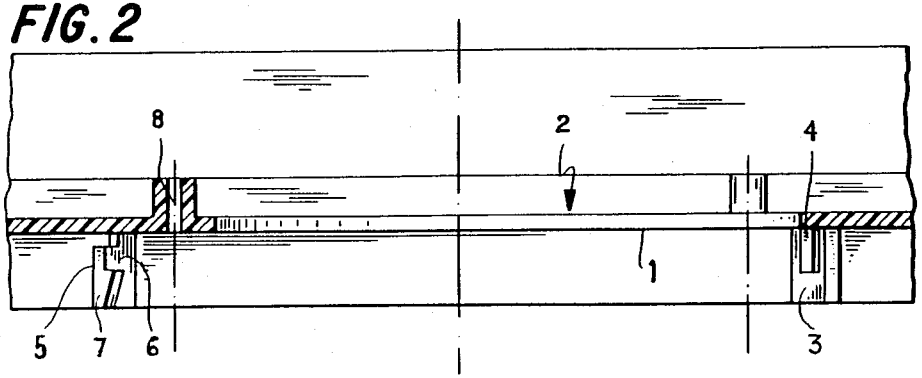
FIG. 2 shows a plan view, partially in section, of the frame shown in FIG. 1 taken in the direction of section lines A—A.

FIG. 1 shows the front frame 1 of a television receiver with the sound opening 2 for an oval loudspeaker. On diametrically opposite points of one diagonal line through the area of the opening 2, there is provided rigid projections 3 with respective openings 4. The projections 3 are injection moulded in plastics integrally with the frame 1.

In addition, there is provided at each of two diametrically opposite points along another diagonal line through the area of the opening 2, a projection 5 projecting out of the plane of the frame 1. The projection 5 is made flexible by a slot 6 in the direction of the plane of the frame 1 and has at its upper end a barb-like attachment 7 with a sloped surface.

The frame 1 also has provided with four tapped holes 8 to receive self-tapping screws.

To fasten a loudspeaker with a plastic chassis by means of a positively-locking click-stop fastening, without screws, the loudspeaker is urged toward the frame 1 in the direction at right angles to the plane of the frame 1. In this way, flexible projections 9 on the chassis of the loudspeaker are deflected by the projections 3 until finally barb-like ends of the projections on the loudspeaker snap into the openings 4 of the projections 3 (see FIG. 3). The loudspeaker is then positively locked on the frame 1 without play. The projections 5 on the frame 1 are in this case not needed and have no importance in holding the loudspeaker.

To fasten a loudspeaker with a metal chassis, the loudspeaker is also urged toward the frame 1 in the direction at right angles to the plane of the frame 1. In this case, flanges 10 of the loudspeaker first strike against the projections 7 and thereby causes a deflection of the flexible projections 5 radially with respect to the opening 2. In the final position, the flanges 10 of the loudspeaker engage and are held under barb-like attachments 7 so that the loudspeaker is held by the projections 5 on the frame 1 (see FIG. 4). This holding including frictional holding is not a final fastening but is rather a so-called "pre-fixation" or "positional fixing" procedure. That is, serves only for determining the position of the loudspeaker so that holes of the loudspeaker flange coincide with the tapped holes 8. After the "pre-fixing" or "positional fixing" of the loudspeaker, the final fastening of the loudspeaker to the frame 1 takes place by screwing two or four screws through the holes in the loudspeaker flange and into the tapped holes 8. The loudspeaker does not need to be held for the screwing operation, so that the operator has both hands free for the screwing operation. Alternately, the screwing operation can be performed by robots. Thus, the projections 5 serve for temporary positional fixing and holding, and then no longer have any importance for fastening the loudspeaker. The projections 3 have no importance per se for this kind of fastening. However, they can, if need be, serve as guides and as stops for the loudspeaker flange.

The projections 3 and 5 are offset with respect to the direction of the short axis of the oval-shaped opening 2 by an angle of about 15° so that the projections can be relatively closely positioned with respect to the opening 2. This has the following advantage. If the projections were to lie exactly in the direction of the short axis, the space required between the projection in the direction of the long axis (section line A-A) would be greater. This is particularly disadvantageous in the case of a television receiver in which space for mounting the loudspeaker is restricted. Thus, a reduction of the spacing between two projections 3 and 5 and, thereby, an increase in space in the receiver can be achieved by the offset position of the projections 3 and 5.

We claim:

1. A frame apparatus for fastening one of two different mounting types of loudspeakers to the same frame, comprising:

positively locking click-stop means attached to said frame without screw fastening; and clip means for holding the other type of said loudspeakers in a position suitable for screwing to said frame, said other type of said loudspeakers being suitable for screw attachment to said frame.

2. The frame apparatus according to claim 1, wherein:

said clip means effects a frictional fastening.

3. The frame apparatus according to claim 1, wherein:

said clip means includes two clip elements which are provided at locations disposed diametrically on opposite sides of a loudspeaker opening in said frame.

4. The frame apparatus according to claim 3, wherein:

said opening is oval shaped having two axes including a lateral axis; and at least one of said clip elements and said click-stop means are angularly offset with respect to one of said axes of said oval-shaped opening.

5. The frame apparatus according to claim 4, wherein:

said angular offset is with respect to said lateral axis.

6. The frame apparatus according to claim 3, wherein:

said clip elements comprise flexible projections which project away from the plane of the frame and which are radially deflectable with respect to the opening.

7. The frame apparatus according to claim 6, wherein:

said projections have barb-like attachments under which a loudspeaker flange is securable.

* * * * *

UNITED STATES PATENT AND TRADEMARK OFFICE

CERTIFICATE OF CORRECTION

PATENT NO. : 4,866,780

DATED : September 12, 1989

INVENTOR(S) : Pascal Mertz, et al.

It is certified that error appears in the above-identified patent and that said Letters Patent is hereby corrected as shown below:

Column 3, line 18 (Claim 1): after "to" and before "said" insert -- the frame for fastening one type of said loudspeakers to --

Signed and Sealed this

Twentieth Day of November, 1990

*Attest:*

HARRY F. MANBECK, JR.

*Attesting Officer*

*Commissioner of Patents and Trademarks*